United States Patent [19]

Herbst

[11] Patent Number: 4,768,893

[45] Date of Patent: Sep. 6, 1988

[54] CONTINUOUS PAPER SUPPLY FEEDER AND TRACKER FOR A PRINTER

[75] Inventor: Manfred O. Herbst, Levittown, N.Y.

[73] Assignee: Esselte Pendaflex Corporation, Garden City, N.Y.

[21] Appl. No.: 60,248

[22] Filed: Jun. 9, 1987

[51] Int. Cl.[4] ..... B41J 11/58

[52] U.S. Cl. ..... 400/613; 400/608; 400/610.2; 400/607.2; 188/65.1; 188/82.84; 242/75.3; 242/55.3

[58] Field of Search ..... 400/608, 608.1, 607, 400/607.2, 610.2, 585, 518–518.2, 613–613.4; 188/65.1, 80, 82.84; 226/91, 92; 242/58, 75.3, 75.2, 55.3

[56] References Cited

U.S. PATENT DOCUMENTS

| | | | |
|---|---|---|---|
| 1,317,374 | 9/1919 | Kuentzel | 242/75.2 |
| 1,534,550 | 4/1925 | Smith | 400/518.2 |
| 2,686,018 | 8/1954 | Courtney | 188/80 |
| 3,037,717 | 6/1962 | Thomasma et al. | 242/75.3 |
| 3,156,392 | 11/1964 | Johannes | 242/75.3 |
| 3,367,589 | 2/1968 | Chant, Jr. et al. | 242/55.3 |
| 3,589,633 | 6/1971 | Young et al. | 242/58 |
| 4,180,118 | 12/1979 | Vecchiarelli | 188/65.1 |
| 4,347,423 | 8/1982 | Katsuke et al. | 188/65.1 |
| 4,408,916 | 10/1983 | Burgert | 400/618 |
| 4,515,490 | 5/1985 | Marker, III | 400/613.2 |
| 4,717,273 | 1/1988 | Elderfield | 400/613.2 |

FOREIGN PATENT DOCUMENTS

| | | | |
|---|---|---|---|
| 314233 | 6/1929 | United Kingdom | 400/618 |

OTHER PUBLICATIONS

Schall, "Constant Force Paper Tensioner", IBM Technical Disclosure Bulletin, vol. 20, No. 9, pp. 3617–3618, 2/78.

*Primary Examiner*—William Pieprz
*Attorney, Agent, or Firm*—Darby & Darby

[57] ABSTRACT

A device for clamping and guiding a continuous sheet paper supply to a printer utilizes an inclined frame that supports pairs of rods. The paper from separate supplies passes between the rods. If not in use, the end of the paper is clamped at a convenient location with respect to the printer by the gravitational force of the upper roller on the inclined plane against the paper sheet and the lower roller. If the paper is connected to the printer, the rollers surrounding the paper may rotate to allow easy feeding to the printer.

3 Claims, 2 Drawing Sheets

CONTINUOUS PAPER SUPPLY FEEDER AND TRACKER FOR A PRINTER

TECHNICAL FIELD

This invention relates to devices for feeding a continuous paper supply to a printer and, more particularly, to a device for easily feeding a selected one of a plurality of continuous paper supplies to the printer.

BACKGROUND ART

The calculations of modern computers are most often used in business in the form of a printed record or "printout" generated by an electronic printer connected to the computer. When the computer is used for a variety of purposes, e.g. creating order forms, invoices, etc., the paper supply for each purpose may be tailored to the particular purpose. In such a case, different supplies of paper must be feed to the printer when the computer is generating different printouts.

Since the purposes for which a computer is used may change a number of times during the day, it is most convenient to store the different supplies of paper in close proximity to the printer, e.g. on shelves of a stand that supports the printer. When a change in the paper supply is needed, the paper in the printer is separated from the continuous supply along perforations typically provided at page intervals along the length of the paper. The separated end of this supply is then secured near the printer where it can be easily located for future use. Then the carriage is advanced manually or under power so that the remaining portion of paper is expelled from the printer. Next, the end of the desired paper supply is located, perhaps in a retainer similar to the one where the end of the other supply was positioned. The end of the new supply is then fed into the printer by advancing the carriage again.

Various devices are known from the prior art for assuring that the paper from the various sources is guided or tracked to the printer from its storage location, and the ends of unused paper supplies are maintained in positions that make them readily available for future use. For example, U.S. Pat. No. 4,059,256 of Palmer discloses a loading rack for feeding multiple supplies of paper or other recording material to a business machine. The rack includes adjustable wire platforms for holding the separate supplies of paper and permitting any supply of paper to be fed to the business machine from its platform without any interference with the other paper supplies. However, no means are provided for holding the ends of unused supplies of paper.

U.S. Pat. No. 2,904,332 of Metzner discloses a strip feeding and separating apparatus for separating carbon paper strips from manifold recording material. The apparatus includes a slanted top portion having a plurality of horizontal chutes defined by downwardly inclined deflector plates. The ends of individual ones of a plurality of the plates protrude through each one of the chutes, respectively. Each one of these plates is directed downwardly at an acute angle, and is bent upward at its lower end to form a shelf for holding an associated strip that is being fed along the plate to the shelf from the associated open chute. Only alternate ones of the plates are associated with a shelf for holding recording paper separated from a carbon strip. Between each one of these first plates there are other plates for guiding separated carbon strips to a take-up roller located at the bottom of the mechanism.

Marker U.S. Pat. No. 4,515,490 discloses a stand for a computer printer including shelves for supporting a plurality of containers holding sheet or web stock printing paper. A horizontal platform at the top of the stand includes a frontal portion for holding the computer printer. Series of elongated horizontal slots are provided with successively higher vertical partitions between the slots. The web in use is fed through a given one of the slots into the printer, but the webs not in use are fed through individual ones of the slots and folded over an associated one of the vertical partitions to keep the ends of the unused webs in close proximity to the printer feed port.

In U.S. Pat. No. 4,408,196 of Burgert there is disclosed a stand for a computer printer incorporating shelves for holding a plurality of continuous forms. The top platform has an area for holding the printer and a frame with a plurality of juxtaposed guide slots through which the ends of the paper webs are fed to the printer. A guide shaft is mounted in each one of the slots. These guide shafts are each mounted eccentrically so the weight of the shaft causes it to rest against a wall of its associated guide slot. The paper webs are located between each shaft and its associated the well so it is held by the force of gravity with a pressure that permits the web in use to be drawn through the guide slot as demanded by the printer. The shaft also provides sufficient pressure to hold the end of any of the unused webs above the top platform for easy access.

While the prior devices accomplish the intended purpose, they either fail to clamp the ends of the papers with sufficient reliability to assure it is always available or clamp it so securely that rapid withdrawal of the paper for high speed printing is inhibited.

DISCLOSURE OF THE INVENTION

The present invention is directed to a paper tracking and holding device for multiple supplies of continuous printer paper, which device utilizes the weight of slidable bars on an inclined plane to clamp and freely feed the paper.

In an illustrative embodiment of the invention, a frame or assembly is provided adjacent the paper entrance to a printer. The frame includes inclined tracks which are separated from each other by the width of the paper to be fed to the printer. The tracks are horizontally divided by tabs into a plurality of sections, each retaining one source of paper. Within each section there is a pair of bars which slide toward the lower end of the section because of the incline of the tracks.

Continuous paper sheets from separate sources are fed between respective pairs of the bars. The gravitational force of the upper roller clamps the sheets in each section to the lower roller with sufficient force to clamp the ends of the paper supplies at a convenient location in proximity to the printer carriage.

The end of the supply in use is fed into the printer in a conventional manner. As it is drawn into the printer during a printing operation, the two bars on either side of that paper are free to rotate in opposite directions so that there is very little force preventing the paper from being drawn into the printer.

BRIEF DESCRIPTION OF THE DRAWINGS

The foregoing and other features of the present invention will be more readily apparent from the following detailed description and drawings of an illustrative embodiment of the invention in which.

DESCRIPTION OF AN ILLUSTRATIVE EMBODIMENT

Figure 1:
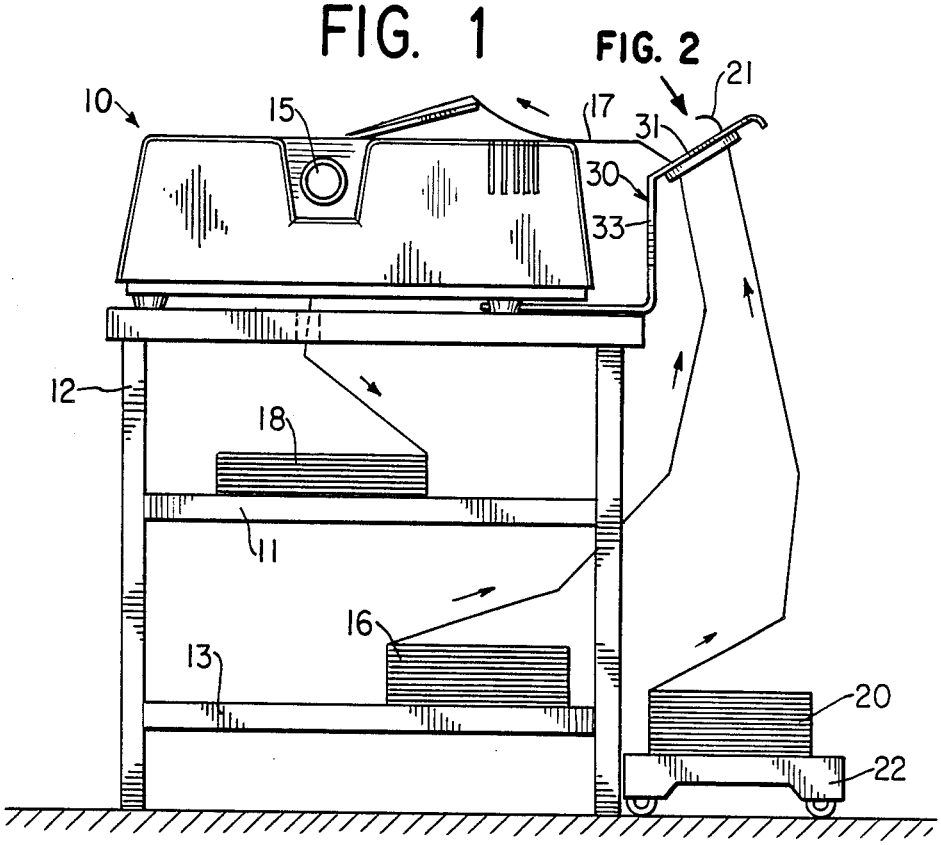
FIG. 1 is a side view of a computer printer stand and a tracker frame according to the present invention.

In FIG. 1 there is shwon a computer perinter 10 resting on a stand 12 which has shelves 11, 13. The bottom shelf 13 contains a supply 16 of fan-folded, continuous sheets of paper for the printer. The supply 16 may consist of blank paper, lined paper, forms, etc.

The leading edge of the supply of paper 16 extends upward and through a paper tracking and retaining device 30, which is made according to the present invention. From the device 30 the paper extends to the carriage of printer 10. After the output computer information is typed onto a portion of the paper by printer 10, the paper extends downwardly through an opening in the stand 10 to shelf 11. On shelf 11 the paper is folded into a stack 18 for storage until the printout is completed.

A second supply 20 of paper in a different form is fed from a storage shelf, e.g. roller platform 22. The end 21 of this paper extends to the tracking and retaining device 30 where it is held at a convenient location for feeding to the carriage of printer 10, should it be desired to print on that type paper.

Figure 2:
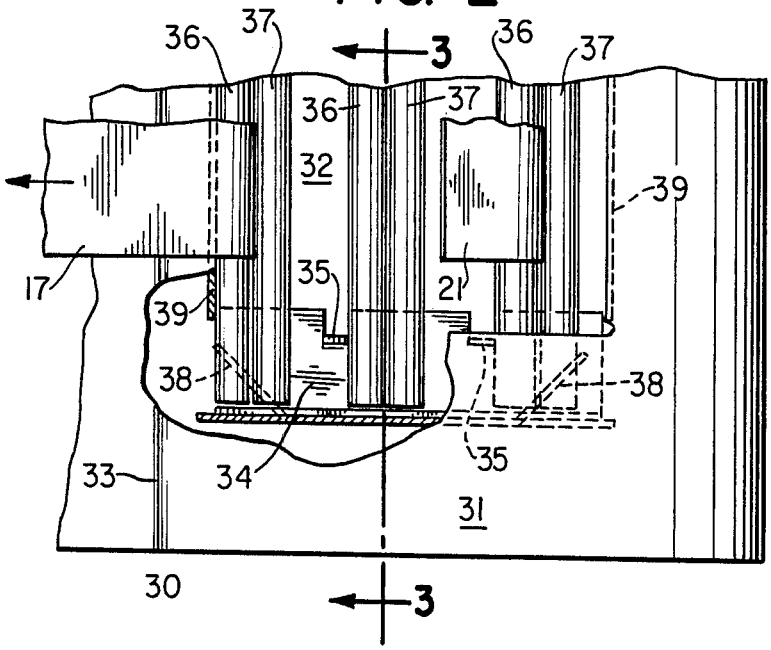
FIG. 2 is an enlarged plan view of a portion of the tracker frame in the direction of the FIG. 2 arrow in FIG. 1.
Figure 3:
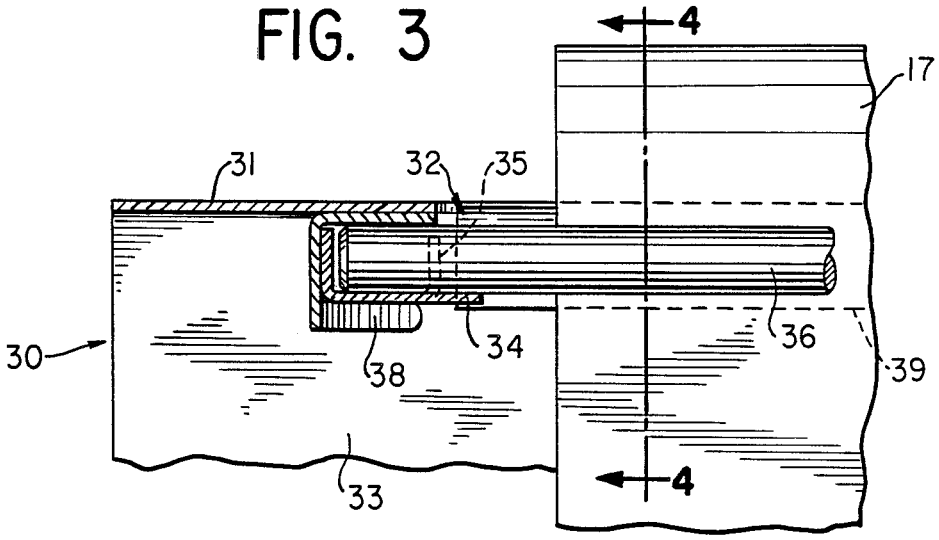
FIG. 3 is a cross-sectional view of a retainer in the tracker frame along line 3—3 of FIG. 2.
Figure 4:
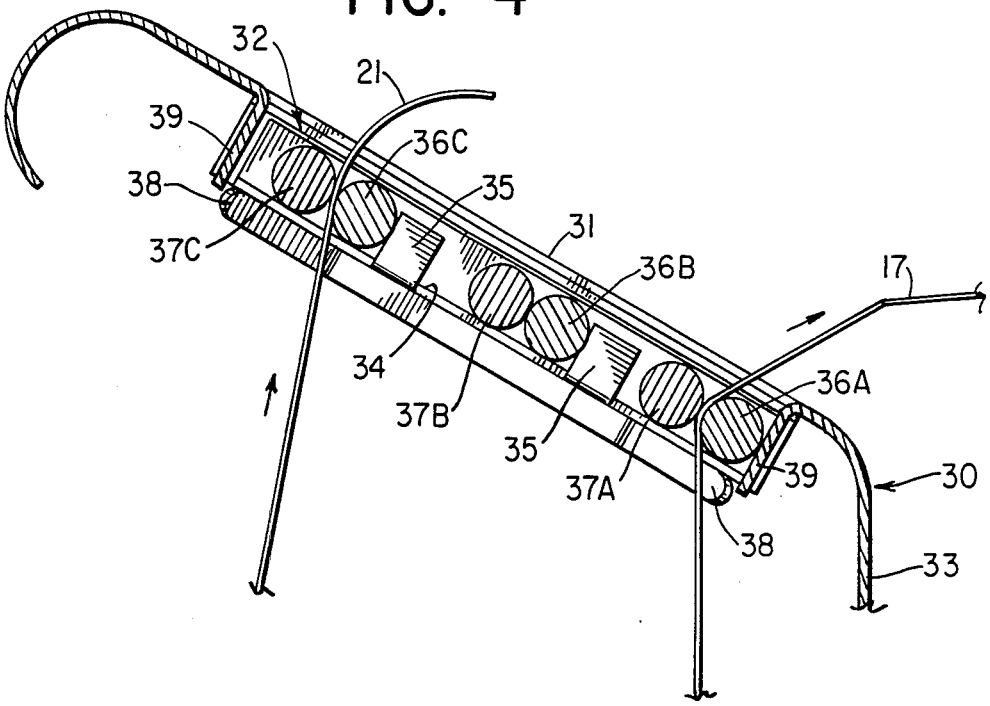
FIG. 4 is a cross-sectional view of bars in the tracker frame along line 4—4 in FIG. 3.

The frame of device 30 has an inclined portion 31 attached to an L-shaped portion 33 that extends below printer 10. A rectangular opening 32 (shown partially in FIG. 2) is provided in inclined portion 31. This opening 32 is wide enough for the paper supply to pass through without impediment. At each side of the opening 32 there is a flange 34 that is generally in the plane of surface 31. The flange portion 34 may be held in place by an extension 38 of a bracket extending from surface 31 (FIG. 3). However, at particular locations portions of the flanges 34 are bent upward to form stop fingers 35. (FIG. 4).

Pairs of rods 36, 37, preferrably of metal, extend across opening 32 from one flange 34 to the other. Each pair of rods is located in separate segments of the structure defined by the end walls of opening 32 and the stop fingers 35 (FIG. 4). The slope of surface 31 and flanges 34 causes the rods 36, 37 to slide or roll to the left in FIG. 2 and right in FIG. 4 until the lowermost rod 36 engages a stop finger 35 or end wall 39. The weight of the slope of surface 31, creates a clamping force that clamps paper end 21 between the rolls.

The size of the clamping force can be adjusted by using rods of different weight and/or by changeing the pitch of surface 31. The clamping force, however, can be very light since it need only be slightly greater than the weight of the few sheets of paper extending from the paper stacks 20 to the device 30.

The portion 17 of paper from the stack 16, which also extends between a pair of rods 36, 37, also experiences the clamping force. However, this paper is fed into the carriage of the printer and the printer exerts a pulling force on the paper during a printing operation. This pulling force easily overcomes the light clamping force. In addition the clamping force is reduced when the paper is pulled because the rods are free to rotate in opposite directions, allowing the paper to pass through. As showin in FIG. 4, the rods 36A, 37A rotate in the direction of the arrows indicated thereon as the paper 17 is drawn between then by the printer carriage.

Once a printout has been completed on a particular paper supply, e.g. supply 16 in FIG. 1, it is separated along conventional perforations at the portion between the tracker device 30 and the carriage of printer 10. Then the carriage is rotated electronically or manually by carriage knob 15 until the trailing end of the paper clears the carriage and is stacked on pile 18. The ile of paper can then be removed for distribution to those in need of the printout.

The separation of the paper between the printer and the tracker device removes any pulling force from the printer on the paper and allows the clamping force of rollers 36A, 37A to hold it in place, ready for future use.

The end 21 of the supply of paper 20 (FIG. 4) can be grasped and pulled between rollers 36C, 37C to the carriage of the printer, where it is inserted and used as the print medium. While paper supply 20 is shown on rolling cart 22, it should be clear that it could be located at any other convenient position, including the shelves of printer stand 121.

It can be seen that with the present invention, the ends of multiple paper supplies can be conveniently located for easy insertion in the printer. The holding or clamping force of this invention, which is due to pairs of rollers on an inclined plane that slide together, is light and can be controlled. Consequently, this force is no impediment to withdrawal of paper for feeding into the printer, even during high speed operation. This is especially true since the force is reduced during withdrawal by rotation of the rollers.

While the invention has been particularly shown and described with reference to a preferred embodiment thereof, it will be readily understood by those skilled in the art that various changes in form and details may be made therein without departing from the spirit and scope of the invention.

What is claimed is:

1. Apparatus for holding and feeding a continuous paper supply to a printing device, comprising a frame having an inclined surface, said surface defining an opening through which sheets of the paper supply with top and bottom surfaces can pass; and at least one pair of rods positioned in the opening and extending completely across the opening, said rods being located such that respective ones of the pairs of rods are in contact with the top and bottom surfaces of the paper, said rods being freely slidable and axially rotatable in the opening such that the rod which is higher up the inclined surface may move against the lower one, due to the force of gravity, and clamp the sheet of the paper between the rods.

2. Apparatus as claimed in claim 1 wherein said at least one pair of rods is a plurality of pairs of rods, each pair of rods being adapted to hold between them sheets of paper from a different continuous paper supply.

3. Apparatus as claimed in claim 2 wherein the rods are freely movable on flanges along the edge of the opening at both ends of the rods, a portion of said flange being raised between said pair of rods so as to form a stop which confines the pairs of rods to separate portions of the opening.

* * * * *